US005603375A

United States Patent [19]

Salt

[11] Patent Number: 5,603,375

[45] Date of Patent: Feb. 18, 1997

[54] HEAT TRANSFER DEVICE

[75] Inventor: Harry Salt, North Caulfield, Australia

[73] Assignees: Commonwealth Scientific and Industrial Research Organisation, Campbell; The Commonwealth of Australia Dept. of Defense, Canberra, both of Australia

[21] Appl. No.: 466,751

[22] Filed: Jun. 6, 1995

Related U.S. Application Data

[63] Continuation of Ser. No. 94,135, filed as PCT/AU92/00030 Jan. 31, 1992, abandoned.

[30] Foreign Application Priority Data

Feb. 1, 1991 [AU] Australia ..... PK 4402/91

[51] Int. Cl.[6] ..... F28D 15/00

[52] U.S. Cl. ..... 165/104.26; 165/46

[58] Field of Search ..... 165/46, 104.26, 165/104.33

[56] References Cited

U.S. PATENT DOCUMENTS

| | | | |
|---|---|---|---|
| 3,256,703 | 6/1966 | Selwitz | 165/46 |
| 3,296,819 | 1/1967 | Gough . | |
| 3,316,732 | 5/1967 | Burton . | |
| 4,279,294 | 7/1981 | Fitzpatrick et al. | 165/46 |
| 4,997,032 | 3/1991 | Danielson | 165/104.33 X |
| 5,000,256 | 3/1991 | Tousignant | 165/104.33 X |

FOREIGN PATENT DOCUMENTS

| | | | |
|---|---|---|---|
| 10967/83 | 8/1983 | Australia . | |
| 75381/91 | 11/1991 | Australia . | |
| 059581 | 9/1982 | European Pat. Off. . | |
| 267890 | 11/1988 | Japan | 165/46 |
| 0646183 | 2/1979 | U.S.S.R. | 165/46 |
| 1402789 | 6/1988 | U.S.S.R. | 165/46 |

OTHER PUBLICATIONS

IBM Technical Disclosure Bulletin, Convection Cooling in Small Terminals, H. B. Parsapour, vol. 24 No. 2 Jul. 1981, p. 1222.

*Primary Examiner*—John Rivell
*Assistant Examiner*—Christopher Atkinson
*Attorney, Agent, or Firm*—Lahive & Cockfield; Thomas J. Engellenner; Anthony A. Laurentano

[57] ABSTRACT

A heat transfer device (20) which comprises a collapsible envelope (2) including a liquid transfer (7) which, in use, is in an expanded form and includes a liquid (8) that evaporates from one wall (6) of the envelope and condenses on another wall (5), the condensed liquid being returned via the liquid transfer means (7) to the wall (6) at which evaporation took place.

18 Claims, 8 Drawing Sheets

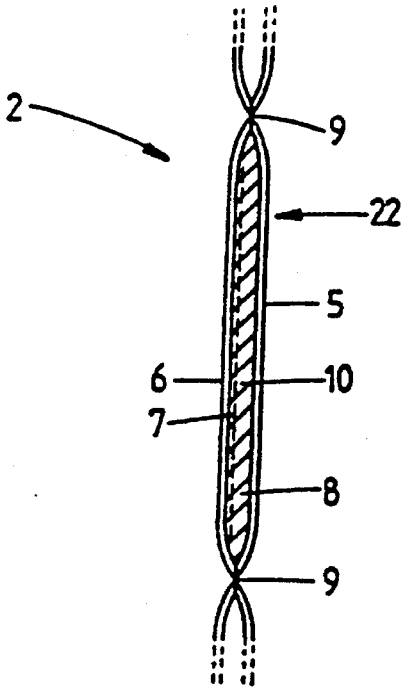
FIG 2 (VIEW A-A)
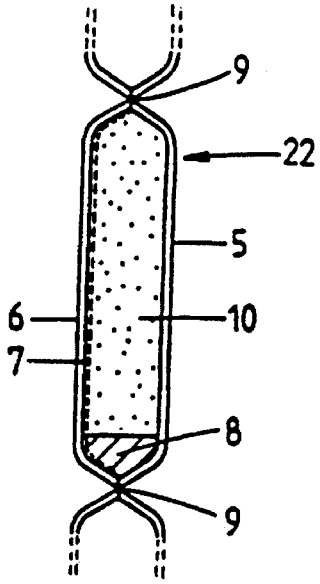
FIG 3
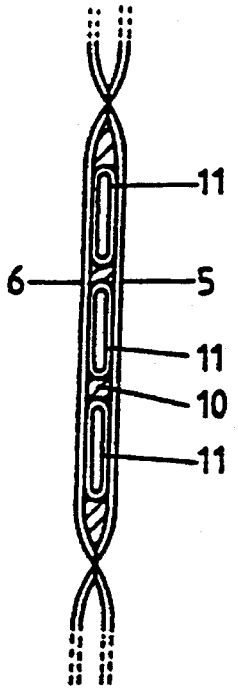
FIG 4 (VIEW A-A)
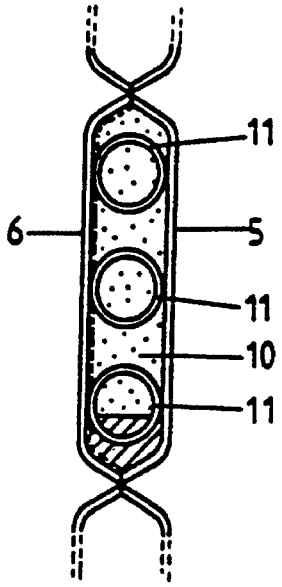
FIG 5

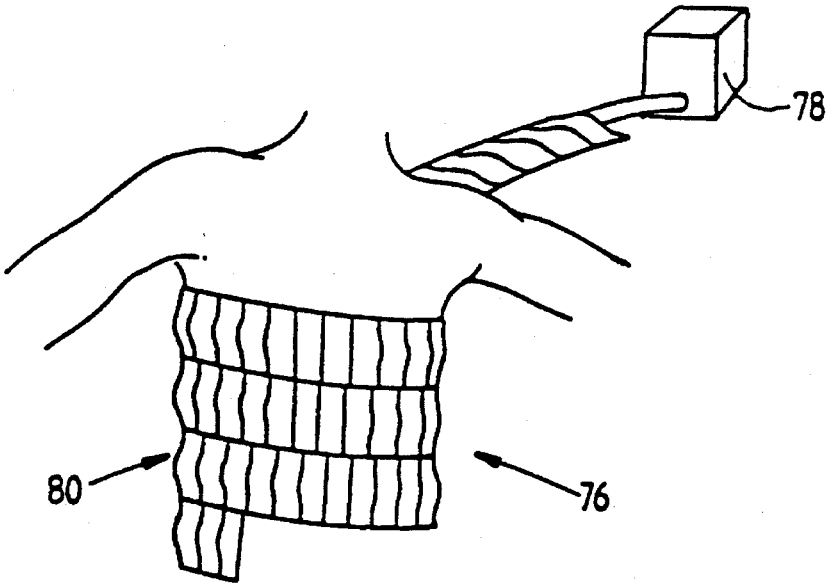
FIG 10
FIG 12
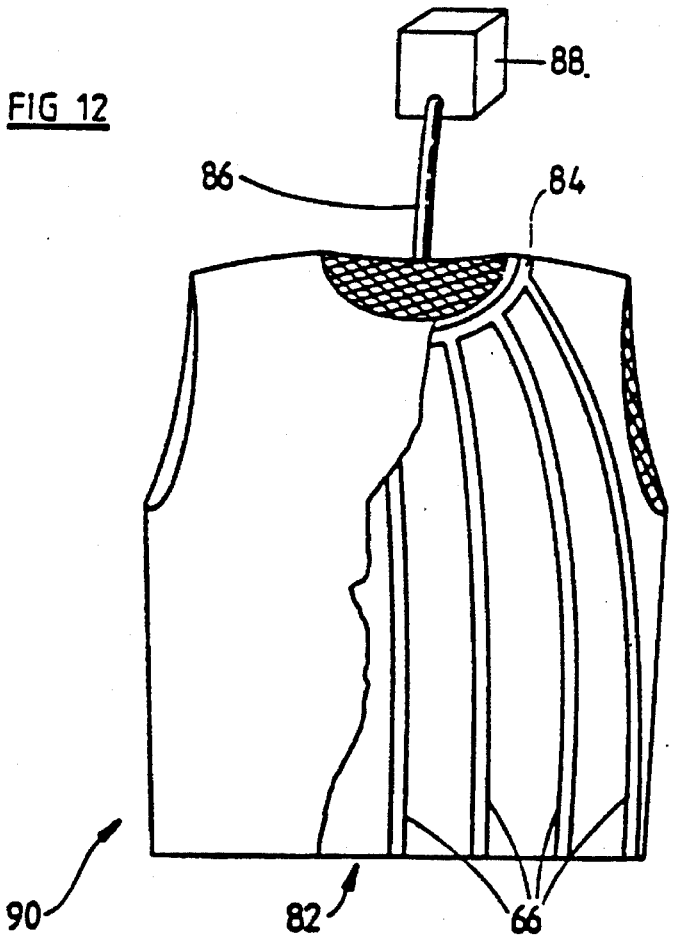

HEAT TRANSFER DEVICE

This application is a continuation of application Ser. No. 08/094,135, filed as PCT/AU92/00030 Jan. 31, 1992 Entitled: HEAT TRANSFER DEVICE, now abandoned.

This invention relates to a heat transfer device.

Heat pipes generally comprise a chamber with liquid and liquid vapour therewithin in equilibrium. These operate to transfer heat applied to one location of the chamber to another location by evaporation of the liquid at the one location and condensation thereof at the other location. Usually, some means, such as a wick, is provided to return condensed liquid to the one location. Usually, heat pipes either have rigid walls defining the chamber or, if the walls are not rigid, there is some internal structure within the chamber to prevent collapse of the walls upon themselves when the internal pressure is lower than atmospheric.

Heat pipes may have conformable walls, for example to enable the heat pipe to be pressed against a non-flat surface while maintaining substantial contact with the surface. These heat pipes are however not collapsible in the sense that they can be collapsed to a form where they may occupy less volume.

In one aspect, the invention provides a heat transfer device comprising a collapsible envelope including liquid transfer means and which, in use, is in an expanded form and includes liquid and vapour thereof in equilibrium whereby the device is then effective to transfer heat from one part of the envelope to another part of said envelope by evaporation of the liquid at said one part and condensation of the evaporated liquid at said another part, the evaporated liquid, once condensed, being returned via the liquid transfer means to the one part of the envelope.

Heat transfer can be increased by providing a heat conductive body to transfer heat externally away from that part on which the liquid in use condenses. The heat conductive body may be in the form of, for example, a metal plug. In many practical applications, it is desired to transfer heat to the body from a part of the envelope opposite the body and in that case, in use, the body may be coupled to a suitable heat exchanger arranged to cool the body.

In another aspect there is provided a heat transfer device comprising a collapsible envelope including liquid transfer means and a heat exchanger coupled to said envelope arranged whereby, in use of the device, the envelope is in an expanded form and contains liquid and vapour thereof so that heat from one part of the envelope is transferred to the heat exchanger by evaporation of the liquid at a part of the envelope and condensation of the evaporated liquid at the heat exchanger, the condensed liquid being returned via the liquid transfer means to said part at which evaporation took place.

In another aspect there is provided a heat transfer device comprising a collapsible envelope including liquid transfer means and a heat exchanger said envelope being, in use, in an expanded form and including liquid and vapour thereof in equilibrium whereby to function as a heat pipe, said heat exchanger being coupled to said envelope by means of a further heat transfer device which extends from the heat exchanger to the interior of the envelope and, in use, also functions as a heat pipe so that heat is transferred from one part of the envelope to said heat exchanger via the further heat transfer device.

Preferably the liquid transfer means is a wick.

The liquid may be present in the device before the envelope is, in use of the device, rendered in an expanded form. The liquid may be selected such that, at a required operating temperature condition, the liquid becomes at least partly vaporized whereby to increase pressure within the device to expand the envelope. In this form, the aforementioned temperature may be chosen to correspond to a temperature in the region of 290°–310° K. Suitable liquids arc trichlorofluoromethane with a boiling point of 23.7° C., nitrogen dioxide with a boiling point of 21.5° C. and pentane with a boiling point of 36° C.

Preferably, the device further comprises valve means for introducing the liquid into the device, such as prior, or during a step of expanding the envelope.

It is possible, for example, to form the heat transfer device as a garment which may be supplied in a collapsed form, ie flat, but which, when worn, assumes a condition where the envelope is expanded, under increased pressure within the device, such as due to said temperature condition then prevailing. Such temperature condition may be brought to prevail due to proximity of the device to a wearer's body. The collapsed device may be compactly stored at a lesser temperature.

Preferably, the envelope is, in use, rendered into an expanded form by expansion means whereby to increase the volume of the envelope so that at least part of the liquid is rendered into a vapour phase, said device thereby being functional as a heat pipe.

In this case, opposed walls of the envelope may be interconnected by resilient means which is normally held compressed but which can be released to apply resilient bias to force opposed walls of the envelope apart to effect said increase in volume whilst providing structural support for the envelope. Embodiments may be constructed wherein the liquid is selected as mentioned above in terms of its temperature of vaporization.

Preferably structure is provided to, in use of the device, maintain said expanded form.

Preferably, the further heat transfer device is resiliently deformable.

Preferably, the further heat transfer device contains another liquid having a lower boiling point than the liquid contained in said envelope.

Preferably, the liquid transfer means is secured to an inside surface of the envelope by, for example glue or welding.

In another aspect there is provided a heat transfer device comprising a collapsible envelope which, in use, is in an expanded form and includes liquid and vapour thereof in equilibrium whereby the device is then effective to transfer heat from one part of the envelope to another part of said envelope by evaporation of the liquid at said one part and condensation of the evaporated liquid at said another part, the evaporated liquid, once condensed, being returned to the one part of the envelope.

Preferably the envelope includes expansion means for, in use, rendering the envelope in said expanded form.

Preferably the liquid is selected so that at least partial vaporization of the liquid occurs in the temperature range of between 290° K. and 310° K.

Preferably the envelope has a cellular structure.

In the case where the device of the invention is formed as a jacket or other garment, the person wearing the garment may then be afforded means for dissipating excess heat generated during, Say, exercise. This is particularly advantageous in the case where the garment is formed as protective clothing of a kind which is designed to otherwise be impervious, such as in garments used by fire fighters or persons in any dangerous location where it is necessary to prevent the body coming into contact with an exterior environment of hazardous chemicals.

The invention is further described by way of example only with reference to the accompanying drawings in which:

FIG. 2 is a cross-section of an envelope of the garment of FIG. 1 in a storage condition taken on the line A—A in FIG. 1;

FIG. 3 shows the envelope of FIG. 2 when expanded;

FIG. 4 is a cross-sectional view like FIG. 2 but showing the structure of a modified heat transfer device in an inoperative condition;

Figure 6:
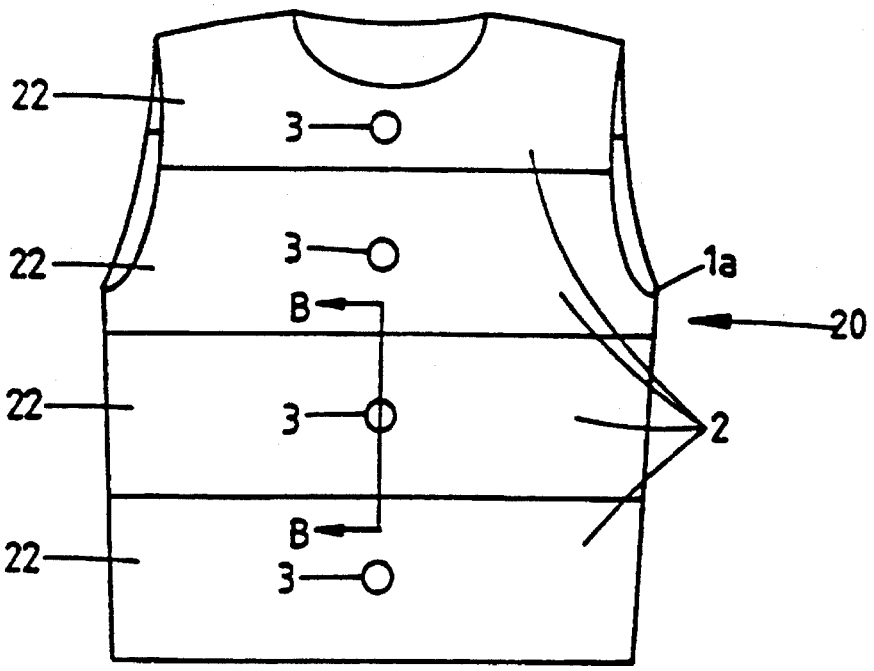
Figure 5A:
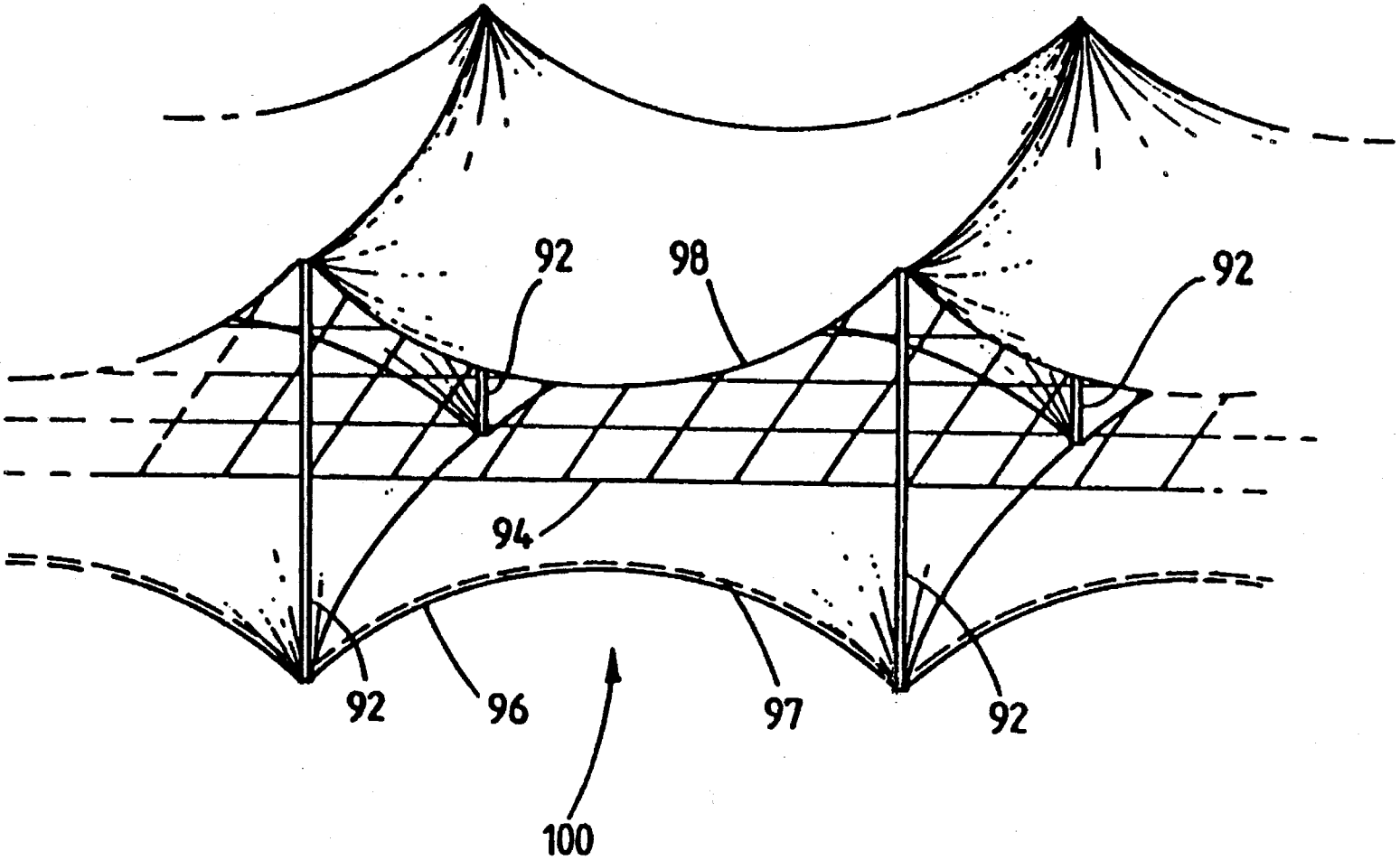
FIG. 5 shows the device of FIG. 4 when expanded.
Figure 7:
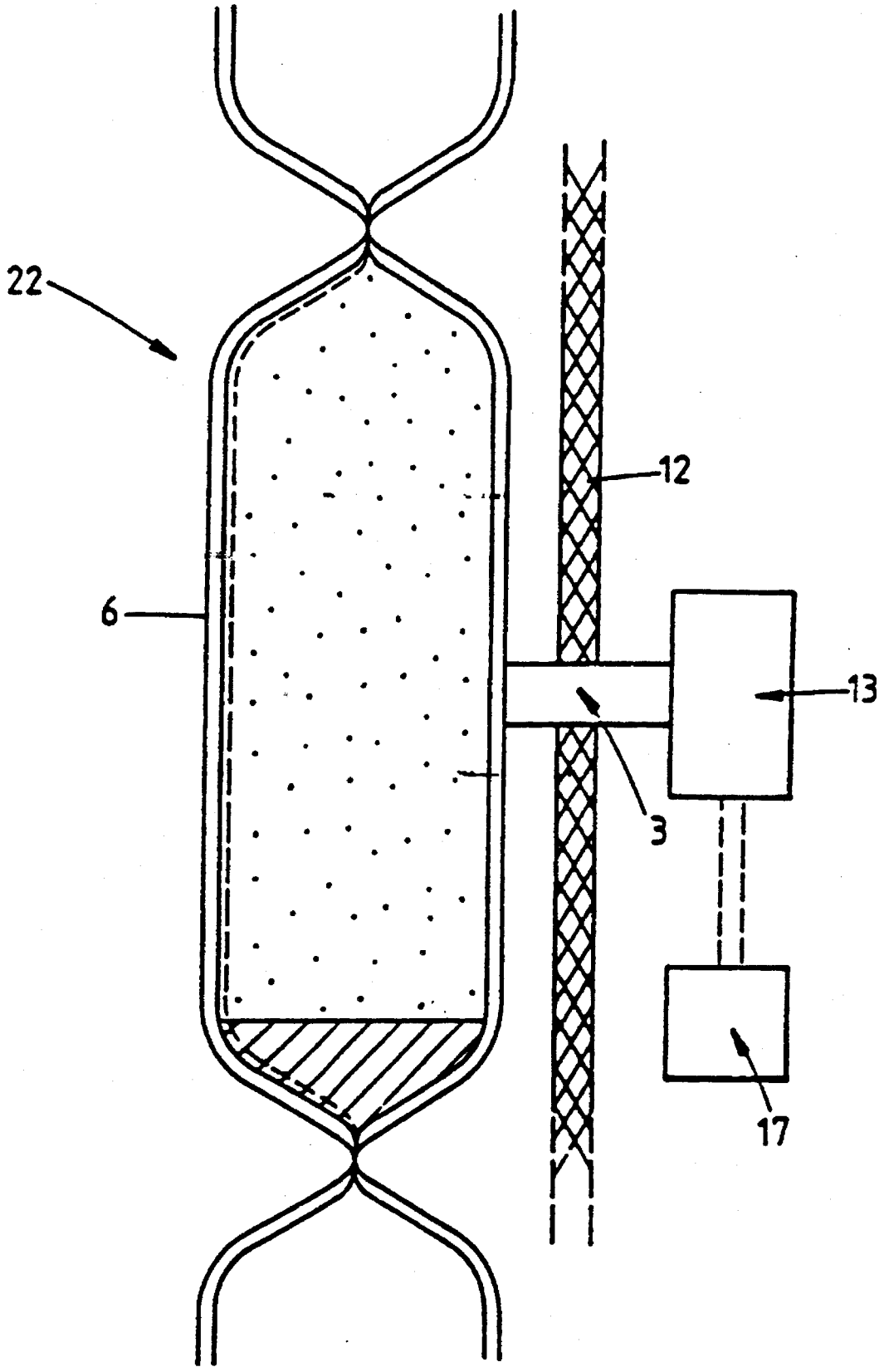
Figure 8:
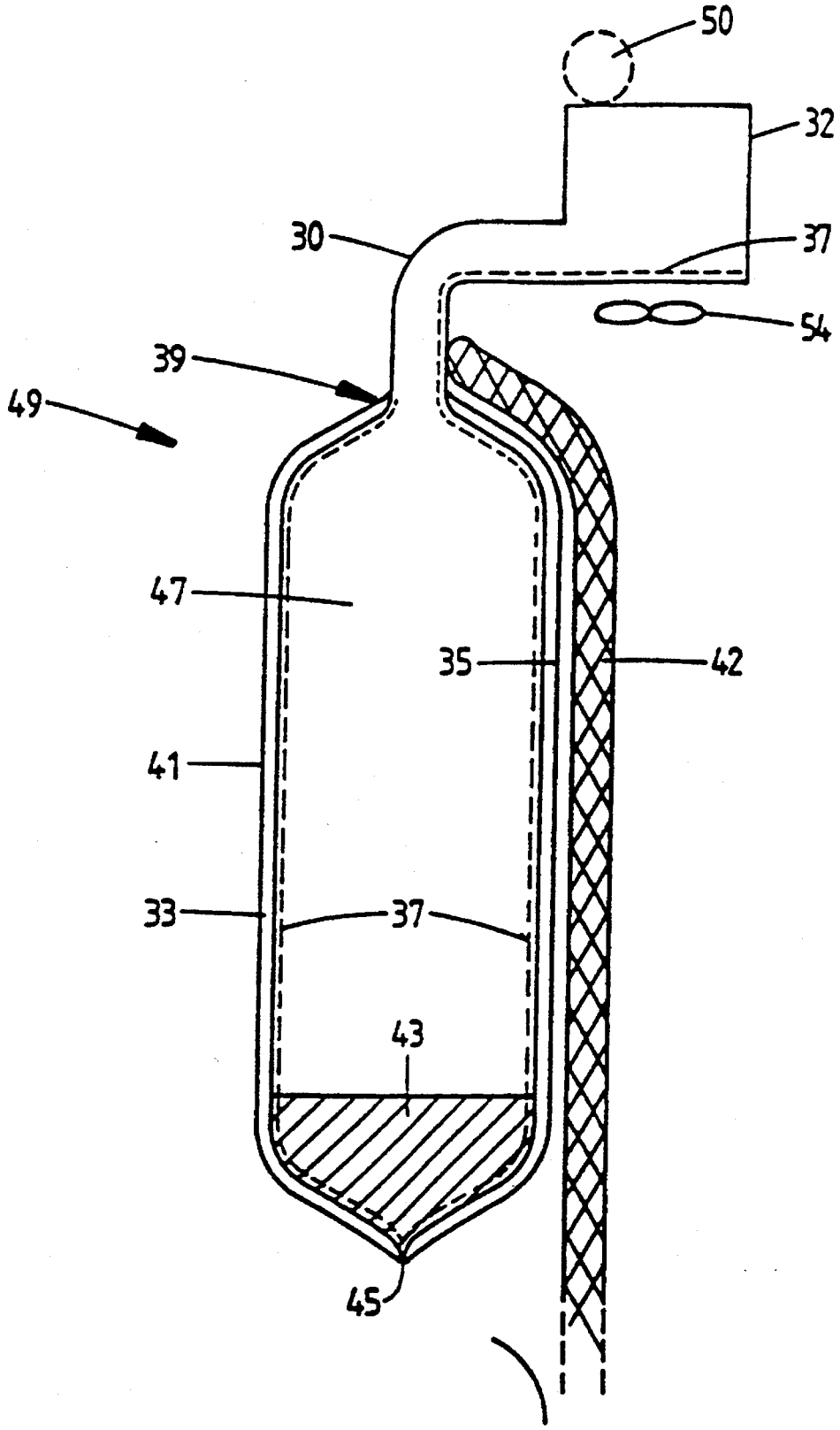
Figure 9:
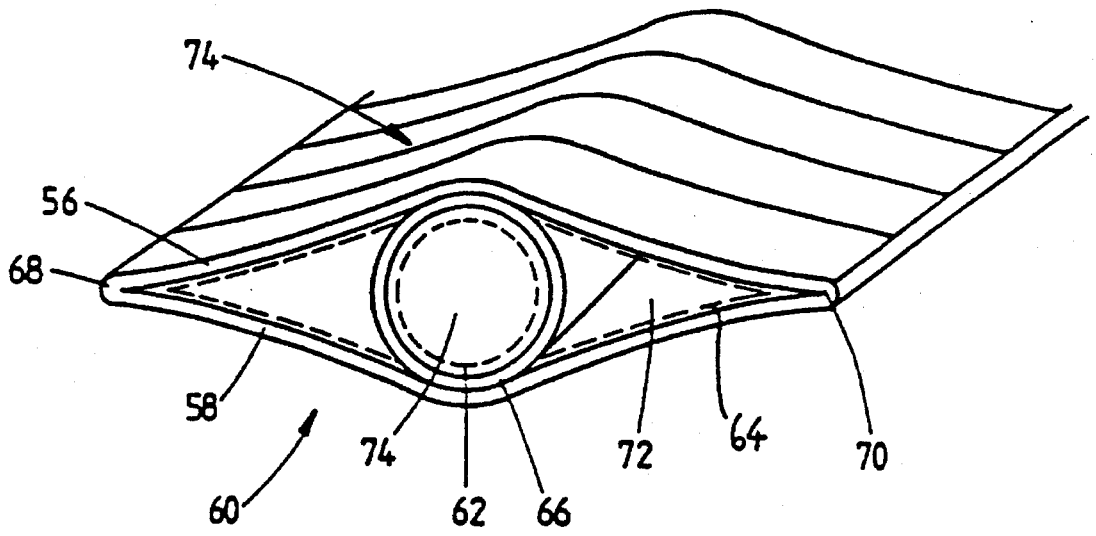
Figure 11:
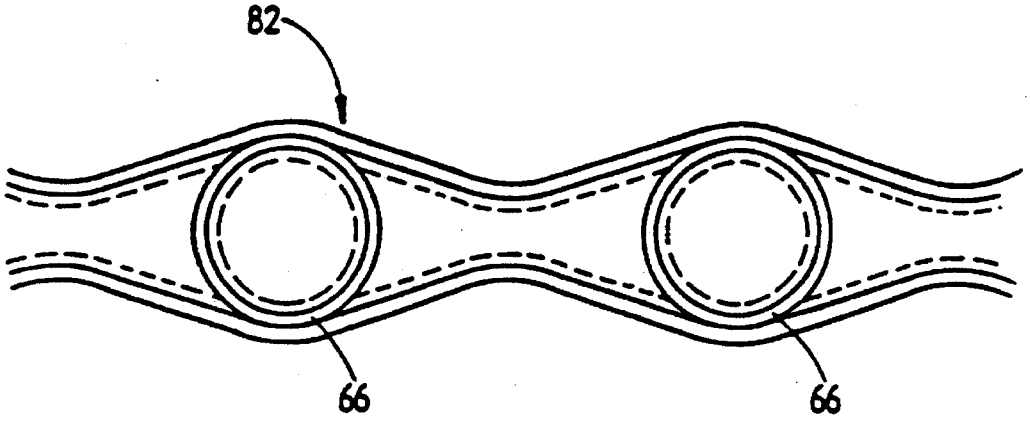

FIG. 5*a* is a cross-sectional view showing the structure of another modified heat transfer device in accordance with the present invention;

FIG. 6 is a front view of a modified heat transfer device in the form of a heat transfer garment;

FIG. 7 is a cross section of an envelope forming the garment of FIG. 6 taken on the line B—B in FIG. 6, in use with protective clothing;

FIG. 8 is a cross section of a modified heat transfer device, in accordance with the present invention, in use with protective clothing;

FIG. 9 is a perspective cut-away view showing the structure of a modified heat transfer device in accordance with the present invention;

FIG. 10 is a perspective view of the device of FIG. 9 in use;

FIG. 11 is a cross-sectional view showing the structure of a modified heat transfer device in accordance with the present invention; and FIG. 12 is a cut-away front view of the device of FIG. 11 in the form of a heat transfer garment.

Figure 13:
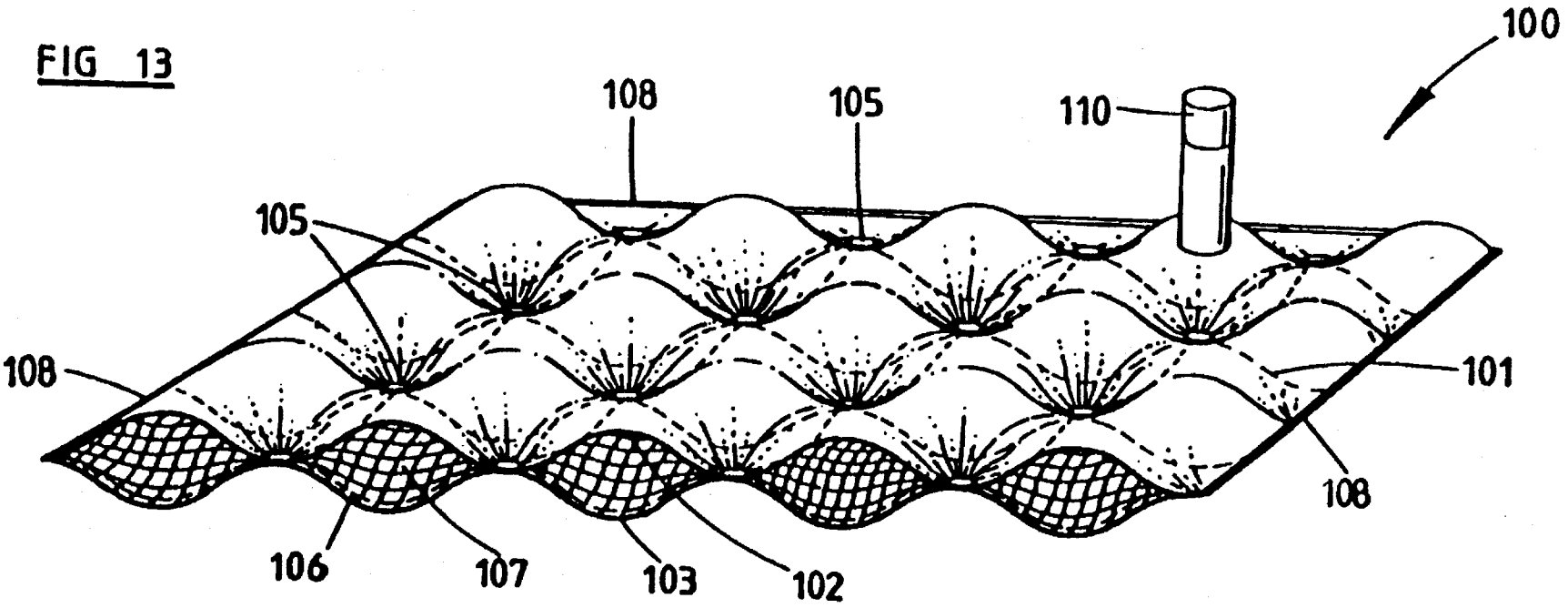

FIG. 13 is a cut-away perspective view of a modified heat transfer device in accordance with the present invention.

Figure 1:
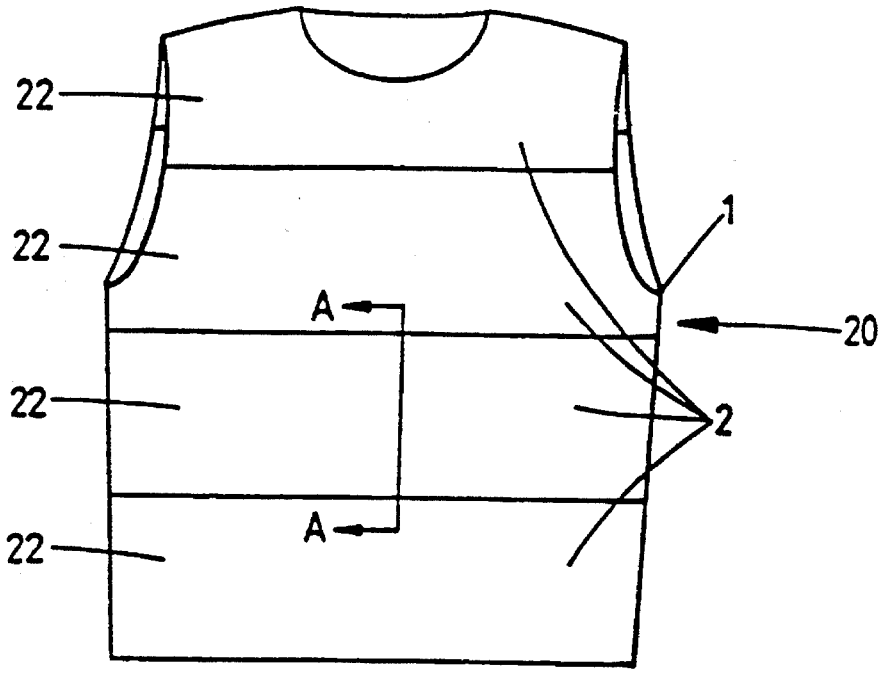
FIG. 1 is a front view of a heat transfer device constructed in accordance with the invention in the form of a heat transfer garment.

Referring firstly to FIG. 1, there is shown therein a heat transfer device 20 in the form of a heat transfer garment, more particularly being a jacket 1. Jacket 1, comprises connected envelopes 2 of a heat pipe structure 22.

Envelopes 2 of jacket 1 are generally similar and one is shown in FIG. 2. The structure 22 is formed of two opposed flexible walls 5 and 6, directly overlaying each other and sealed at the edges to form seals 9, the illustrated envelope 2 being defined by the walls 5 and 6 and two spaced seals 9. The walls 5 and 6 may be made of a thin plastic, and sealed by heat sealing, gluing or other conventional sealing methods, or the walls 5 and 6 may be metallized so as to effect metal-to-metal seals 9. The walls 5 and 6 so connected at seals 9, define a cavity 10 within the envelope 2 which contains a liquid 8. The liquid may occupy the whole of this cavity or at least substantially the whole thereof. This figure also shows a saturated wick 7 within the cavity.

In the condition of FIG. 2, the jacket 1 is collapsed. In particular the walls 5 and 6 are relatively closely spaced and the cavity 10 is collapsed. Thus the jacket 1 may be considerably flattened for storage. However, when the garment is taken from storage and worn, body heat from the wearer causes expansion of the garment so that it can then operate as a heat pipe to transfer heat away from the wearer. This expansion occurs by vaporization of part of the liquid 8 within each envelope 2.

FIG. 3 shows the structure 22 when the jacket 1 is in use, where heat generated adjacent wall 6 has so vaporized a portion of the liquid 8 that the vapour pressure within the chamber 10 now slightly exceeds atmospheric pressure and the volume of the chamber 10 is increased. For example, at 37° C., trichloroflouromethane will exert a pressure of 160 kPa (59 kPa above atmospheric pressure), whilst pentane will exert a pressure of 104 kPa. The relative volume increase associated with the increased pressure is dependant on the size of the jacket 1. The expansion arises through outward pressure on the walls 5 and 6, so that these become further spaced apart than in the collapsed state of FIG. 2. In the condition of FIG. 3, heat may be transferred from wall 6 such that liquid distributed on the inner surface will vaporise from the wall 6 and condense on wall 5. The condensed liquid will pool at the bottom of cavity 10 and be returned to the wall 6 via wick 7. The arrangement of FIG. 3 is effective to provide a cooling effect for the wearer of the jacket 1. Thus the envelopes 2 operate as conventional heat pipes where body heat applied to one location of each (ie at the then innermost wall 6) is transferred to the outermost wall 5 by evaporation of the liquid at the inner surface of one wall 6 and condensation thereof at the inner surface of the other wall 5.

The wick may be formed of any conventional wicking material effective to absorb liquid and effect transport and distribution of the liquid throughout the wick. Suitable materials include fiberglass cloth, textile cloth, cotton or any woven plastics such as nylon, and in any event it is preferable that the wick be flexible. The wick may be secured to the inner surface of wall 6 by, for example, glue or welding.

In storage, the pressure of the cavity 10 is atmospheric and so the pressure on the seals 9 is minimal. When in use (as shown in FIG. 3), the seals 9 should be effective in maintaining the internal pressure of the jacket 1. However it is envisioned that, in at least some applications, a large portion of the lifetime of the jacket 1 may be spent in storage and that the jacket 1 may further only be used once for a relatively short period of time. In such a case it is not therefore necessary for the seals to be capable of long term sealing.

The envelopes 2 may have some internal structure such as shown in FIGS. 4 and 5. These envelopes are designed particularly but not exclusively for the case in which vapour pressure generated by the body heat will not be sufficient to effect the separation of the walls 5 and 6. The construction shown in FIGS. 4 and 5 is generally similar to that of FIGS. 2 and 3. Like reference numerals denote like parts in each of these figures and the following description is confined to matters of difference as between the construction of FIGS. 2 and 3 and that of FIGS. 4 and 5. In the arrangement of FIGS. 4 and 5, resilient tubular structures 11 are incorporated within the envelope to allow for additional structural support. The tubular structures 11 are deformable (as shown in FIG. 4) such that the jacket 1 of FIG. 1, whilst in an inoperative state, may be considerably flattened either by the collapse of the envelope upon itself, brought about by the reduced internal pressure resulting from the cooling of the liquid and liquid vapour through non-use of the jacket, or by application of external mechanical force (not shown). The jacket 1 will then be in a convenient form for packaging and storage or transportation.

Upon use of the jacket 1, the resilient tubular structures 11 apply a resilient bias, in order to assume a non-flattened form (shown in FIG. 5) and force the walls 5 and 6 apart, thereby increasing the volume of the cavity 10. The jacket 1 then functions in the same manner as the embodiment of FIGS. 2 and 3.

As an alternative to providing tubular structures 11 for internal support, many other internal support structures may also be used. For example, the embodiment of FIG. 5*a* shows internal structure of an envelope 100 comprising longitudinal members 92 secured to protrude from a central mesh plate 94 in order to maintain a spaced arrangement between walls 96 and 98. A wick 97 is also provided. The mesh structure is porous to allow circulation of liquid vapour, whilst also being flexible to allow a degree of freedom to the envelope 100 when formed, for example, as a jacket to conform to a wearers body. A heat transfer device formed of the envelope 100 functions similarly to the above mentioned embodiments in transferring heat from a hotter surface, say 96, to a cooler surface 98. The members 92 may also be formed of resilient material, so that the structure may be substantially flattened upon application of an external force.

FIG. 6 shows a modified heat transfer device, in the form of jacket 1*a* with heat conducting bodies, in the form of metallic plugs 3 attached thereto. The jacket 1*a* functions substantially identically to jacket 1 of FIG. 1, and like reference numerals denote like parts in each of these figures, but heat transfer is enhanced by the conduction of heat away from the garment via plugs 3. This is achieved by cooling the metallic plugs 3 to a temperature below that of the immediate environment surrounding the jacket 1*a*. Jacket 1*a* may be worn under a covering protective garment 12 (as shown in FIG. 7), and heat transfer from the jacket 1*a* to the exterior environment will be effected via the plugs 3.

FIG. 7 shows a cross sectional view of a section of the jacket 1*a* of FIG. 6 in use, and the covering protective garment 12. The jacket 1*a* functions in such a way that heat generated from the body of the wearer adjacent wall 6, being the wall closest to the body of the wearer will be transferred to the metallic plug 3 which protrudes through the covering protective garment 12, and which is in this instance coupled to a heat exchanger 13. This heat exchanger may be further coupled to a cooling device 17 which for example is either chemically or electrically operated. In this manner, the wearing of the jacket 1*a*, beneath the covering protective garment 12, such as in fire fighting or chemical warfare, will not cause over-heating of the wearer due to the heat energy dissipated by exertion, but provide means whereby the heat generated can be dissipated by the metallic plugs 3 to the external environment and thereby maintain a comfortable temperature for the wearer of the covering protective garment 12. The heat flow path is thus from the wearer's body, via the heat pipes constituted by the jacket 1*a*, thence through the wall of the covering protective garment 12 via the plug 3 to the heat exchanger 13 and thence to the cooling device 17.

As an alternative to transferring heat to the heat exchanger 13 via the plug 3, a conduit in the form of a tube 30 may be provided to allow liquid and liquid vapour to pass directly between an envelope 41 of a device 49 and the heat exchanger 13, as shown in the embodiment of FIG. 8.

The envelope 41 is formed of two walls 33 and 35 in spaced apart arrangement, joined at one end 45 and connected to a tube 30 at the other end 39, so as to form a cavity 47. Within the cavity 47 there is a liquid 43, chosen from the aforementioned liquids, and vapour thereof in equilibrium. A wick 37 covers the interior surfaces of the walls 33, 35 and, in this instance extends through the tube 30 and along the bottom of the heat exchanger 32. The device 49 functions in a similar manner as the previously described embodiment, except that heat is transferred to the heat exchanger 32 by generation of vapour as a liquid 43 from a wall 33 or 35 due to heating of the liquid 43, and the vapour so generated passing through tube 30 and condensing on a cooled surface of the heat exchanger 32 and then collecting on the bottom surface 34 of the exchanger. The condensed liquid may be returned to the wall at which evaporation took place by wick 37, which collects the liquid at the bottom of the heat exchanger 32 and returns the liquid back through the tube 30 and into the envelope 41, whereat the liquid may be disposed over the wall surface 33 or 35 via wick 37. In this manner liquid may be transferred from a region adjacent a device 49 to the heat exchanger 32. This is particularly useful when, as mentioned in the previous embodiment, it is necessary to position the device, in the form of a jacket, beneath a protective garment 42.

The heat exchanger 32 may also have a liquid canister 50 attached thereto so that liquid can be disposed over the exterior surface of the exchanger 32. Alternatively or additionally a fan 54 can also be arranged to cool the surfaces of the exchanger 32 and thereby enhance the rate of condensation of vapour of liquid 43 on the interior surfaces of the exchanger and increase the effectiveness of the device 49.

In the instance where highly flammable liquid such as pentane is used in the above described embodiments, it is desirable, for safety reasons, to use a minimal amount of such liquid.

For this purpose a modified heat transfer device may be used, the structure of which may be seen in FIG. 9. Envelope 60 comprises walls 56, 58 sealed at end 68, 70 and has a further heat transfer device in the form of tubing 66 located therein. Cavity 74 formed within the robing 66 is sealed from cavity 72 formed between the walls 56, 58. A wick 62 covers the internal wall of the tube 66 defining the cavity 74 and another wick 64 covering the internal surface of the walls 56, 58 defining the cavity 72. Cavity 74 in this instance holds a highly flammable liquid, whilst cavity 72 contains a liquid with a boiling point such as water. The tubing 66 is connected at one end to a heat exchanger (not shown) and partially filled with the liquid which has a boiling point below that of, for example human body temperature, so that the tubing 66 and connected heat exchanger function identically to the previously described embodiment, resulting in the maintaining of the tubing 66 at a low temperature.

Heat may therefore be transferred from the walls 56, 58 when these walls, or portions thereof, are at a higher temperature than the tubing 66, by evaporation of the liquid within cavity 72 from the wall surface and condensation of the vapour formed therefrom on the inner tubing 66. The condensed liquid being returned to the portion of the wall at which evaporation occurred via wick 64. Thus, envelope 60 allows heat from a large area covered by the walls 56, 58 to be transferred to the heat exchanger via inner tube 66, which due to its small internal volume only requires a small volume of flammable liquid in order to operate efficiently.

If the walls 56, 58 are formed of relatively inflexible metallized material, ridging 74 may be used to provided a degree of flexibility which allows the structure to conform, for example, to a human body as shown in FIG. 10, wherein the envelope 60, as shown coupled to the heat exchanger 88, may be secured at one end and wound around the body 76 to effectively form a heat transfer garment 80, which has similar capabilities as possessed by jacket 1 and jacket 1*a* of FIGS. 1 and 6 respectively. Alternatively, the structure of FIG. 9 may include a plurality of tubing 66 arranged within walls 56, 58 as shown in FIG. 11. The structure shown in FIGS. 9 and 11 is similar, and like reference numerals denote like parts. Such structure may be incorporated into a jacket 90 as shown in FIG. 12, where a plurality of internal tubing 66 communicate with a connecting tube 84. Tube 84 is further connected to a tube 86 which is attached to a heat exchanger 88. In this manner the heat generated by a wearer of the jacket 90 may be transferred from the walls of the..structure 82, to the tubing 66, and through the connecting tubes 84, 86 to the heat exchanger 88.

In the above described embodiments, the internal pressure of the heat transfer device has generally been described as above atmospheric. However, in the case where internal structure is used it is also possible for the internal pressure to be below atmospheric.

A further heat transfer device 100 is shown in an operative condition in FIG. 13. The device 100 comprises an envelope 101 formed of two opposed walls 102 and 103 in generally spaced relation and includes a wick 106 adjacent wall 103.

The walls 102, 103 are secured together along edges 108 to thereby define a cavity 107 within the envelope 101 which contains a liquid and vapour thereof in equilibrium. The walls 102, 103 are also secured together at locations 105 by, for example, welding. This welding also serves to secure the wick 106 to the wall 103 and is effective in forming a cellular type structure throughout the envelope whereby the generally spaced relationship of the walls 102, 103 may be maintained when deformation of the envelope takes place. Such deformation may be caused by, for example, wrapping the envelope about a body to be cooled.

Also shown in FIG. 13 is a valve 110 fixed in the wall 102. Similar valves may be used in any of the above described heat transfer devices to introduce a liquid into the device.

Like the above described devices, the device 100, when not in use, will be substantially flattened-whereby the walls 102, 103 lie generally adjacent one another. Prior to use of the device liquid is introduced into the envelope 101 via the valve 110, the valve 110 may also be used to remove any air displaced by the introduction of the liquid, or, in the case where the pressure within the device 100 is below atmospheric, the valve may also be used to evacuate the envelope 101.

Once the liquid is introduced into the envelope 101, the device may be fitted to conform about a body to be cooled, such as a wearer of a garment formed of the heat transfer device 100. When heat is applied to the device by the wearer, the liquid therewithin will partially vaporized and expand the envelope to a condition shown in FIG. 13. The device 100 will then function as a heat pipe as described with reference to prior embodiments.

Device 100 may also be coupled to a heat exchanger as described with reference to FIGS. 7 to 12.

The described garments, in the inoperative state, may all be substantially flattened and conveniently stored, packaged or transported. The heat transfer device has a long "shelf life", or large capacity for prolonged periods in the inoperative condition, and may be constructed, where possible, so as to be suited to a short period of operation. Such is the requirement of a product in, for example, treatment of hazardous chemicals in which the heat transfer device in the form of a jacket may be integral with, or positioned beneath a protective garment which is impervious to such chemicals, so that the wearer may remain cool during the execution of activities while in the hazardous environment. Ideally the jacket would be kept in a compact storage arrangement until required in an emergency, and then conditioned to be operative, used for a short period only, and returned to its inoperative state. It may even be necessary to discard the jacket if it is contaminated.

The described construction has been advanced merely by way of explanation and many modifications may be made thereto without departing from the spirit and scope of the invention as defined in the appended claims.

I claim:

1. A heat transfer device adapted to conform to a surface of an object, said device comprising a collapsible envelope adapted to house a liquid and a vapor and capable of being substantially flattened, and liquid transfer means associated with the envelope, the device being effective to transfer heat from one part of the envelope to another part of said envelope by evaporation of the liquid at said one part and condensation of the evaporated liquid at said another part, the evaporated liquid, once condensed, being returned via the liquid transfer means to the one part of the envelope, said envelope further including two opposed, generally parallel and flexible walls which are substantially impermeable, the device collapsing into a storage state wherein the walls of the envelope are substantially adjacent relative to each other when disposed in at least a non-use position, and expanding into an expanded state to form a cavity for retaining the liquid and the vapor by relative movement of the walls away from each other in a direction transverse to the walls when disposed in at least a use position, and wherein the walls of the envelope are adapted to conform to the surface of the object when disposed adjacent thereto.

2. A heat transfer device adapted to conform to a surface of an object, said device comprising a collapsible envelope adapted to house a liquid and a vapor and capable of being substantially flattened, liquid transfer means associated with the envelope, and a heat exchanger coupled to said envelope such that when in use, the device is effective to transfer heat from one part of the envelope to the heat exchanger by evaporation of the liquid at said one part of the envelope and condensation of the evaporated liquid at the heat exchanger, the condensed liquid in use being returned via the liquid transfer means to said part at which evaporation took place, said envelope further including two opposed, generally parallel and flexible walls which are substantially impermeable, said device collapsing into a storage state in which the walls of the envelope are substantially adjacent relative to each other when disposed in at least a non-use position, and expanding into an expanded state to form a cavity for retaining the liquid and the vapor by relative movement of the walls away from each other in a direction transverse to the walls when disposed in at least a use position, and wherein either wall of the envelope is adapted to conform to the surface of the object when disposed adjacent thereto.

3. A heat transfer device as claimed in claims 1 or 2, further comprising valve means for introducing the liquid into the device.

4. A heat transfer device as claimed in claims 1 or 2, wherein the liquid is present in the device prior to said envelope being, in use of the device, in an expanded form.

5. A heat transfer device as claimed in claims 1 or 2, wherein the envelope is rendered into said expanded state by at least partial vaporization of the liquid, which serves to increase pressure within the device.

6. A heat transfer device as claimed in claims 1 or 2, arranged for use, wherein expansion means is provided to render the envelope into said expanded form.

7. A heat transfer device as claimed in claim 4, wherein in use of the device, the envelope is rendered into said expanded form by expansion means whereby to increase the volume to the envelope so that at least part of the liquid is rendered into a vapor phase, said device thereby being functional as a heat pipe.

8. A heat transfer device as claimed in claims 1 or 5, wherein the liquid transfer means is secured to an inside surface of the envelope.

9. A heat transfer device as claimed in claims 1 or 5, wherein the liquid transfer means is a wick.

10. A heat transfer device adapted to conform to a surface of an object, said device comprising a collapsible envelope adapted to house a liquid and a vapor and capable of being substantially flattened and which, in use, is effective to transfer heat from one part of the envelope to another part of said envelope by evaporation of the liquid at said one part and condensation of the evaporated liquid at said another part, the evaporated liquid, once condensed, being returned to the one part of the envelope, the envelope further including two opposed, generally parallel and flexible walls which are substantially impermeable, the device collapsing into a storage state wherein the walls of the envelope are substantially adjacent relative to each other when disposed in at least a non-use position, and expanding into an expanded state to form a cavity for retaining the liquid and the vapor by relative movement of the walls away from each other in a direction transverse to the walls when disposed in at least a use position, and wherein the walls of the envelope are adapted to conform to the surface of the object when disposed adjacent thereto.

11. A heat transfer device as claimed in claims 1, 2, 8 or 10, wherein the liquid is selected so that at least partial vaporisation of the liquid occurs in the temperature range of between 290° K. and 310° K.

12. A heat transfer device as claimed in claims 1, 2, 8 or 10 in the form of a garment.

13. A heat transfer device as claimed in claim 12 wherein the garment is a jacket.

14. A heat transfer device as claimed in claims 1, 2, 8 or 10 wherein the envelope has a cellular structure.

15. A heat transfer device as claimed in claims 1, 2, or 10, wherein the device further comprises a body to transfer heat away from said part of the envelope in which the liquid condenses in use.

16. A heat transfer device as claimed in claims 1, 2, or 10, wherein the device further comprises a plurality of said collapsible envelopes.

17. A heat transfer device as claimed in claims 1, 2, or 10, wherein in use of the device, the envelope is rendered into said expanded form by an expansion means.

18. A heat transfer device as claimed in claims 1, 2, or 10, wherein the device further comprises a structure to maintain the device in said expanded state during use.

* * * * *